United States Patent [19]

Nagao et al.

[11] Patent Number: 4,848,214

[45] Date of Patent: Jul. 18, 1989

[54] SUPPLY AND RETURN AIR PLENUM UNIT FOR DUCT AIR-CONDITIONING SYSTEMS

[75] Inventors: Teruyuki Nagao, Konan; Shigeo Tanaka, Ageo, both of Japan

[73] Assignee: Diesel Kiki Co., Ltd., Tokyo, Japan

[21] Appl. No.: 192,704

[22] Filed: May 10, 1988

[30] Foreign Application Priority Data

May 19, 1987 [JP] Japan ..... 62-122079

[51] Int. Cl.[4] ..... F24F 1/02

[52] U.S. Cl. ..... 98/31.6; 98/40.28

[58] Field of Search ..... 98/31.6, 40.24, 40.25, 98/40.28; 165/122

[56] References Cited

U.S. PATENT DOCUMENTS 2,191,141 2/1940 Grant ..... 98/31.6 X
2,191,622 2/1940 Philipp ..... 98/31.6 X

FOREIGN PATENT DOCUMENTS 59-109741 6/1984 Japan ..... 98/40.24
60-185042 9/1985 Japan ..... 98/40.28
60-221652 11/1985 Japan ..... 98/40.24
61-268941 11/1986 Japan ..... 98/31.6

*Primary Examiner*—Harold Joyce
*Attorney, Agent, or Firm*—Wenderoth, Lind & Ponack

[57] ABSTRACT

A supply and return air plenum unit for duct air-conditioning systems includes a return air inlet and a supply air outlet defined in a case in vertical juxtaposition, the supply air outlet having an opening located at a front lower corner of the case. A blow-off grill is disposed in the opening of the supply air outlet and is angularly moved by an actuator for varying the direction of supply air within a range between the horizontal and the vertical.

5 Claims, 2 Drawing Sheets

SUPPLY AND RETURN AIR PLENUM UNIT FOR DUCT AIR-CONDITIONING SYSTEMS

BACKGROUND OF THE INVENTION

1. Field of the Invention

This invention relates to a supply and return air plenum unit for duct air-conditioning systems adapted to be installed in a room of a house or building.

2. Description of the Prior Art

Self-contained room air conditioners are generally installed in a room of a house or building in the form of a wall unit, ceiling-hung unit, ceiling-built-in unit, or floor-mounted unit. Such a self-contained room air conditioner is relatively large in size as it contains relatively thick heat exchangers and a blower. The large-sized air conditioner projects into the room interior to a greater extent and hence is unsightly in appearance and also occupies a relatively large space in the room. Duct air-conditioning systems, unlike the self-contained room air conditioners, include a supply and return air plenum unit which is devoid of heat exchangers and a blower and hence can be constructed in a thin or flat structure. Two typical examples of such plenum unit are illustrated here in FIGS. 4 and 5 of the accompanying drawings. The plenum unit shown in FIG. 4 is installed in an offset portion of a ceiling and has a cooled/heated air supply outlet A defined in a vertical side wall and a return air inlet B defined in a horizontal bottom wall. The plenum unit shown in FIG. 5 is also mounted on an offset ceiling and has a cooled air supply outlet A1 defined in a vertical side wall, a heated air supply outlet A2 and a return air inlet B both defined in a horizontal bottom wall.

The first-mentioned plenum unit is disadvantageous in that since the cooled/heated air supply outlet defined in the vertical side wall directs heated air horizontally, the heated air is unlikely to flow in a downward direction. Consequently, a uniform temperature distribution is difficult to obtain when the air conditioning system is operating in a heating mode.

The foregoing difficulty never occurs in the latter-mentioned plenum unit in which heated air is blown off downwardly from the supply outlet A2 and cooled air is supplied horizontally from the supply outlet A1. However, a mode select door is required for selectively opening and closing the supply outlets A1, A2. With the mode door thus provided, this plenum unit is complicated in construction. Another problem is that, owing to a close arrangement of the heated air supply outlet A2 and the return air inlet B, heated air supplied from the supply outlet A2 tends to shortcut and returns through the air inlet B into the plenum unit before it is circulated in the room interior.

OBJECTS OF THE INVENTION

With the foregoing drawbacks in view, it is an object of the present invention to provide a supply and return air plenum unit for duct air-conditioning systems which is capable of distributing temperature-controlled air uniformly over the room interior.

Another object of the present invention is to provide a supply and return air plenum unit which is relatively thin and hence sightly in appearance and occupies only a small space for its installation.

A further object of the present invention is to provide a supply and return air plenum unit having structural features which prevent supply air from shortcircuiting between a supply air outlet and a return air inlet.

SUMMARY OF THE INVENTION

According to the present invention, the foregoing and other objects are attained by a supply and return air plenum unit for duct air-conditioning systems, comprising:

a case having an upper return air inlet and a supply air outlet disposed below said return air inlet and having one end opening at a lower corner of said case;

a blow-off grill movably disposed in said supply air outlet adjacent to said lower corner for supplying conditioned air;

means for displacing said grill to change a direction of air blown-off from said grill;

a first shutter disposed in said return air inlet for adjusting the open area of said return air inlet; and a second shutter disposed in said supply air outlet for adjusting the open area of said supply air outlet.

With this construction, the grill disposed at the lower corner is turned to vary the direction of supply air within an angular range between the horizontal and the vertical. The conditioned air is therefore distributed uniformly over the entire region of the room, thereby making the room interior comfort.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE INVENTION

A preferred structural embodiment of the present invention will be described below in greater detail with reference to the accompanying drawings.

Figure 1:
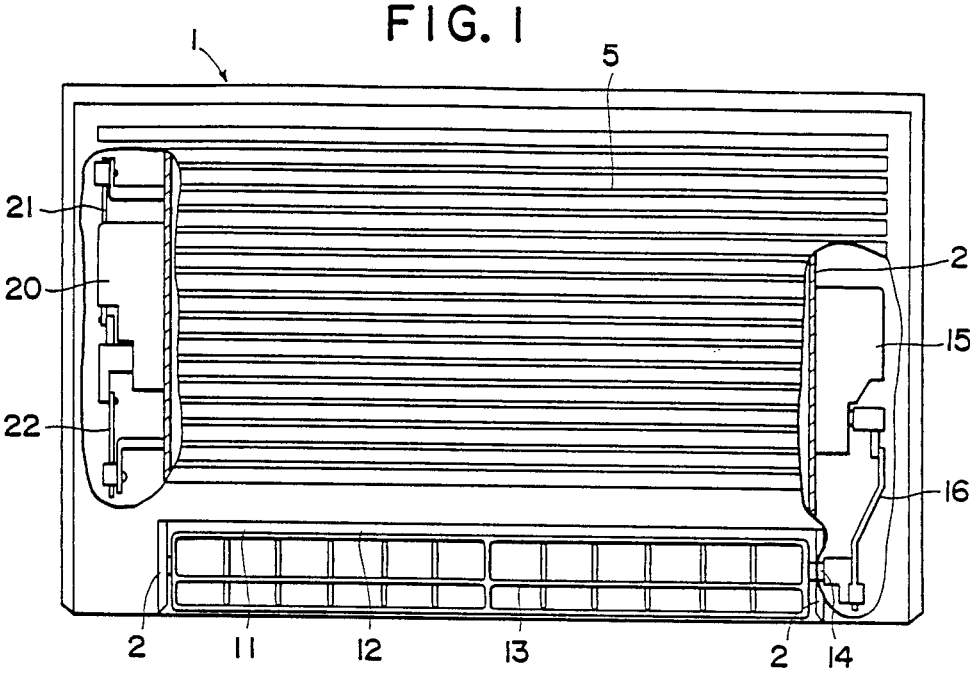
FIG. 1 is a front elevational view of a supply and return air plenum unit for duct air-conditioning systems embodying the present invention.
Figure 2:
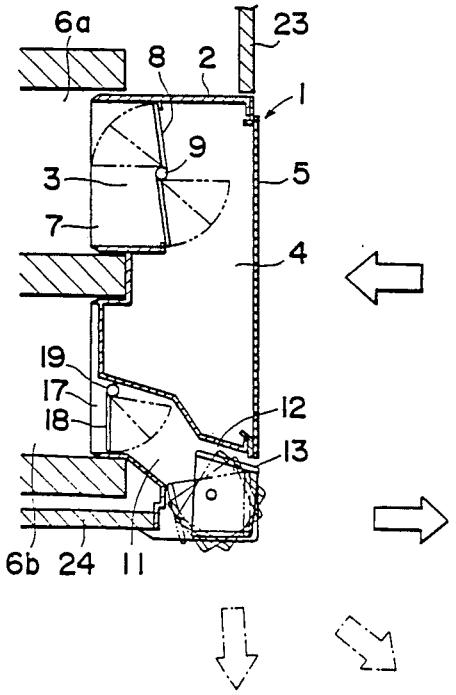
FIG. 2 is a vertical cross-sectional view of FIG. 1.

In FIGS. 1 and 2, there is shown a supply and return air plenum unit 1 embodying the present invention. The plenum unit 1 includes a generally rectangular case 2 having a return air inlet 3 defined in an upper portion thereof. The return air inlet 3 has an enlarged front end opening in a horizontal direction and forming a first opening 4 extending over a substantial part of the front side of the case 2. A cover or screen 5 covers the first opening 4. The rear end of the return air inlet 3 solely forms a second opening 7 connected with a duct *6a*, the second opening 7 extending horizontally throughout the width of the case 2. With this arrangement, return air is drawn from the upper part of a room through the first opening 4 into the return air inlet 3 and then is guided through the second opening 7 into the duct *6a*.

A first damper or shutter 8 is disposed in the return air inlet 3 and rotatable about the axis of a horizontal shaft 9 to adjust the open area of the return air inlet 3 at a desired value between zero (where the inlet 3 is fully closed) and the maximum (where the inlet 3 is fully opened). The angular position of the first shutter 8 is controlled by an actuator 20 described later on.

A supply air outlet 11 is defined in a lower portion of the casing 2 and disposed in vertical juxtaposition with the return air inlet 3. The supply air outlet 11 has a front end opening at a lower corner of the case 2, and solely forming a horizontally elongated third opening 12. A blow-off grill 13 is disposed in the third opening 12 for deflecting the conditioned air into the room. The grill 13 is complementary in contour to the shape of the third opening 12 and is secured to a shaft 14 having one end connected with a lever 16 which is in turn connected with a first actuator 15, such as an electric motor. With this arrangement, the grill 13 is angularly moved by the first actuator 15 through an angle of 90 degrees between a horizontal position and a vertical position. Operation of the first actuator 15, i.e. the angular position of the grill 13, is controlled automatically in accordance with a selected conditioning mode or manually in accordance with the user's instructions. In general, when the duct air-conditioning system is operating in a heating mode, the grill 13 is disposed in the vertical position to direct heated air vertically downwardly. On the contrary, in the cooling mode, the grill 13 is disposed in the horizontal position to direct cooled air in a horizontal direction. The rear end of the supply air outlet 11 solely constitutes a fourth opening 17 connected with a duct **6*b*. The supply air outlet 11 is inclined downwardly forwardly so that the fourth opening 16 is directed obliquely upwardly. With this arrangement, cooled air or heated air fed through the duct 6*b* into the supply air outlet 11 of the plenum unit 1 is blown-off from the grill 13** into the room.

A second damper or shutter 18 is disposed in the supply air outlet 11 adjacent to the fourth opening 17 and rotatable about the axis of a horizontal shaft 19 to adjust the open area of the supply air outlet 11 in the same manner as the first shutter 8. The angular position of the second shutter 18 is controlled by the second actuator 20. The second actuator 20 is composed of an electric motor, for example, operatively connected with the first and second shutters 8, 18 via a pair of link mechanisms 21, 22, respectively, for controlling not only the position of the second shutter 18 but also the position of the first shutter 8.

Reference numerals 23 and 24 designate vertical (front) and horizontal (bottom) decorative face plates, respectively, of the offset ceiling.

Figure 3:
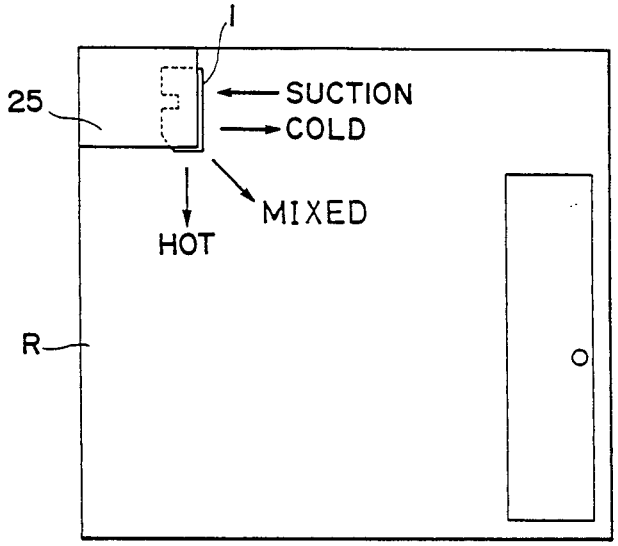
FIG. 3 is a diagrammatical view illustrative of the manner in which the plenum unit shown in FIG. 1 is installed in an offset ceiling.
Figure 4:
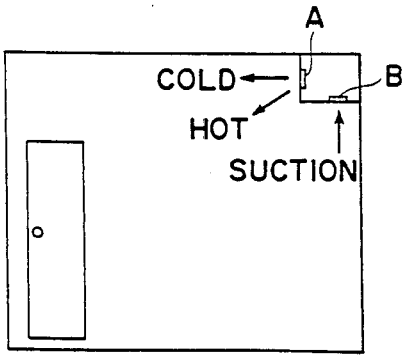
FIG. 4 PRIOR ART
FIGS. 4 and 5 are diagrammatical views showing conventional supply and return air plenum units installed in offset ceilings.
Figure 5:
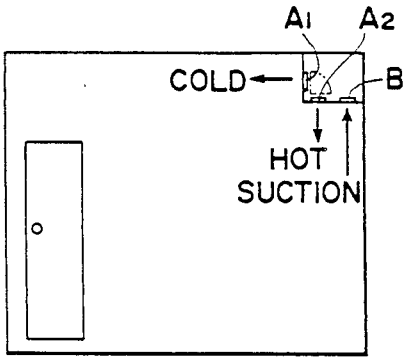
FIG. 5 PRIOR ART

As shown in FIG. 3, the supply and return air plenum unit 1 of the foregoing construction is installed in an offset portion 25 of a ceiling of a room R. In this condition, the vertical side (front face) and the horizontal side (bottom face) of the plenum unit 1 projects into the room R only to an extent equal to about 10 mm and hence does not give an unpleasant sense of oppression to an occupant.

When an air-conditioning unit (not shown) of the duct air-conditioning system is to be operated in a cooling mode or in a heating mode, a desired condition is inputted through a controller (not shown) disposed in the room interior. Upon operation of the air-conditioning unit, the cooled air or heated air is forced to flow through the duct **6*b* toward the second opening 17 of the plenum unit 1. The angular position of the second shutter 18 is controlled depending on the room temperature with reference to the preset desired or target temperature. The cooled air or the heated air is forced from the duct 6*b* into the supply air outlet 11 which in turn is blown off from the grill 13 toward an area in the room which is determined by the angular position of the grill 13. The grill 13 is directed vertically downwardly when the system is operating in the heating mode while it is forced in a horizontal direction during the cooling operation mode. It is possible to hold the grill 13 in any inclined position at the user's desire. The room air is drawn from the first opening 4 into the return air inlet 3 which in turn is returned through the duct 6*a*** to the air-conditioning unit.

The temperature of blown-off air is controlled by the second shutter 18 in such a manner that the second shutter 18 is turned in a direction to gradually close the supply air outlet 11, thereby lowering the heat supply to the room as the difference between the actual room temperature and the preset target temperature is reduced.

When an air conditioning of the room is not required, the supply air outlet and the return air inlet 3 are closed by the second and first shutters 18, 8, respectively to thereby prevent wasteful consumption of heat energy.

Obviously, various modifications and variations of the present invention are possible in the light of the above teaching. It is therefore to be understood that within the scope of the appended claims the invention may be practiced otherwise than as specifically described.

What is claimed is:

1. A supply and return air plenum unit for connection to the inlet and outlet ducts of a room in an air-conditioning system, comprising:

an air plenum case having an upper return air inlet and a lower supply air outlet disposed below said return air inlet, said return air inlet having a first opening on a front side of said air plenum case and a second opening at a rear side of said case opposite said front side, said supply air outlet having an end opening at a lower corner of said air plenum case, said lower corner comprising a substantially L-shaped front lower corner of said air plenum case;

a blow-off grill rotatably mounted in said supply air outlet at said lower corner of said air plenum case for supplying conditioned in;

means for rotating said blow-off grill to change the direction of air blown through said grill between a substantially horizontal position wherein air is directed horizontally by said blow-off grill and a substantially vertical position wherein air is directed vertically by said blow-off grill;

a first shutter disposed in said return air inlet for adjusting the amount of air returning through said inlet; and a second shutter disposed in said supply air outlet for adjusting the amount of air supplied through said supply air outlet.

2. The supply and return air plenum unit as set forth in claim 1, and further comprising:

means for adjusting the position of said first shutter so as to adjust the amount of air returning through said return air inlet.

3. The supply and return air plenum unit as set forth in claim 1, and further comprising:

means for adjusting the position of a said second shutter so as to adjust the amount of air supplied through said supply air outlet.

4. The supply and return air plenum unit as set forth in claim 1, and further comprising:

means for simultaneously adjusting the positions of said first and second shutters so as to simultaneously adjust the amount of air returning through said return air inlet and supplied through said supply air outlet.

5. The supply and return air plenum unit as set forth in claim 1, wherein:

said means for rotating said blow-off grill comprises means for rotating said blow-off grill to said substantially horizontal position when cool air is blown through said grill and for rotating said blow-off grill to said substantially vertical position when warm air is blown through said grill.

* * * * *